US007777708B2

(12) United States Patent
Drader et al.

(10) Patent No.: US 7,777,708 B2
(45) Date of Patent: Aug. 17, 2010

(54) CROSS-TALK CORRECTION FOR A LIQUID CRYSTAL DISPLAY

(75) Inventors: Marc Drader, Kitchener (CA); James Robinson, Elmira (CA); Alex Kornilovsky, Waterloo (CA)

(73) Assignee: Research in Motion Limited, Waterloo, Ontario (CA)

( * ) Notice: Subject to any disclaimer, the term of this patent is extended or adjusted under 35 U.S.C. 154(b) by 702 days.

(21) Appl. No.: 11/524,514

(22) Filed: Sep. 21, 2006

(65) Prior Publication Data

US 2008/0074366 A1 Mar. 27, 2008

(51) Int. Cl.
*G09G 3/36* (2006.01)

(52) U.S. Cl. ..... 345/87; 345/100

(58) Field of Classification Search ..... 345/2.3, 345/36, 48, 87, 100, 107, 156, 166, 175, 345/178, 204, 211, 214, 613, 3.1, 7; 348/446; 382/100, 108, 250, 274, 103, 251, 294, 300; 250/221, 370.09; 359/560; 715/864; 438/30
See application file for complete search history.

(56) References Cited

U.S. PATENT DOCUMENTS

| | | | | | |
|---|---|---|---|---|---|
| 4,845,482 | A | | 7/1989 | Howard et al. | |
| 4,945,406 | A | * | 7/1990 | Cok | 358/506 |
| 5,018,218 | A | * | 5/1991 | Peregrim et al. | 382/103 |
| 5,038,216 | A | * | 8/1991 | Easterly et al. | 348/364 |
| 5,173,949 | A | * | 12/1992 | Peregrim et al. | 382/294 |
| 5,670,973 | A | | 9/1997 | Bassetti, Jr. | |
| 5,691,739 | A | | 11/1997 | Kawamori | |
| 5,774,103 | A | | 6/1998 | Choi | |
| 5,798,740 | A | | 8/1998 | Bitzakidis | |
| 5,966,678 | A | * | 10/1999 | Lam | 702/97 |
| 5,994,157 | A | * | 11/1999 | Aggas et al. | 438/30 |
| 6,020,590 | A | * | 2/2000 | Aggas et al. | 250/370.09 |
| 6,084,584 | A | * | 7/2000 | Nahi et al. | 715/864 |
| 6,360,021 | B1 | | 3/2002 | McCarthy et al. | |
| 6,766,064 | B1 | * | 7/2004 | Langan et al. | 382/274 |
| 7,012,749 | B1 | * | 3/2006 | Mendlovic et al. | 359/560 |
| 7,194,139 | B1 | * | 3/2007 | Sariel et al. | 382/250 |
| 7,227,522 | B2 | * | 6/2007 | Fujimoto et al. | 345/87 |
| 7,388,610 | B2 | * | 6/2008 | Pinto et al. | 348/251 |
| 7,557,338 | B2 | * | 7/2009 | Gruhlke et al. | 250/221 |
| 2002/0080107 | A1 | * | 6/2002 | Fujimoto et al. | 345/87 |
| 2003/0048922 | A1 | * | 3/2003 | Rhoads | 382/100 |

(Continued)

FOREIGN PATENT DOCUMENTS

EP 1324305 A1 7/2003

*Primary Examiner*—Prabodh M Dharia
(74) *Attorney, Agent, or Firm*—McCarthy Tétrault LLP

(57) ABSTRACT

A method for reducing cross-talk on a liquid crystal display begins by receiving pixel data defining an image comprising a plurality of pixels; the received pixel data includes an intensity value associated with each pixel. The image is compressed by reducing the range of the intensity values of all the pixels in the image; the compressing step comprising arithmetically adjusting the intensity values of the pixels. Lines in the compressed image that are disposed to create cross-talk are identified. The image is then decompressed by applying a scale factor to the adjusted intensity value associated only with the pixels in the identified lines. The scale factor is selected such that a display image rendered on a liquid crystal display from the pixel data of the decompressed image has less cross-talk than a display image rendered on a liquid crystal display from the received pixel data.

16 Claims, 7 Drawing Sheets

U.S. PATENT DOCUMENTS

2003/0095080 A1* 5/2003 Colmenarez et al. ..... 345/7
2004/0239587 A1 12/2004 Murata et al.
2005/0264492 A1 12/2005 Knapp
2006/0147128 A1* 7/2006 Kondo et al. ..... 382/300
2006/0238545 A1* 10/2006 Bakin et al. ..... 345/613
2007/0116376 A1* 5/2007 Kolterman et al. ..... 382/274
2007/0139299 A1* 6/2007 Huang et al. ..... 345/3.1
2008/0112677 A1* 5/2008 Smith ..... 385/119
2008/0165275 A1* 7/2008 Jones et al. ..... 348/446
2008/0232647 A1* 9/2008 Yamauchi et al. ..... 382/108

* cited by examiner

CROSS-TALK CORRECTION FOR A LIQUID CRYSTAL DISPLAY

FIELD OF THE INVENTION

The invention described herein relates to computer image analysis and processing. In particular, the invention relates to a method and apparatus for reducing cross-talk on a liquid crystal display.

BACKGROUND OF THE INVENTION

The conventional colour liquid crystal display includes a liquid crystal layer, and a semi-transparent metal oxide layer (typically Indium Tin Oxide) that covers the liquid crystal layer. These two layers are sandwiched between two transparent substrates, which are typically provided as glass or plastic plates.

In a passive matrix display, one of the transparent substrates includes a series of parallel data electrodes, and the other transparent substrates includes a series of parallel scanning electrodes that are arranged at a right angle to the data electrodes. The pixels are addressed by applying a pulse to the associated data electrode, while grounding the associated scanning electrode.

In an active matrix display, one of the transparent substrates includes a matrix of thin-film transistors and storage capacitors. The display includes a transistor for each pixel in the display. The gate electrodes of the transistors in each row are connected together via a common scanning electrode, and the source electrodes of the transistors in each column are connected to a respective source driver. The pixels can be individually addressed by pulsing the scanning electrodes sequentially, and by applying the appropriate voltage signals to the data lines. The storage capacitors maintain the voltage applied to each pixel until the next voltage signal is applied.

In each case, the optical transmittance of the display changes as the liquid crystal moves in response to the voltage applied to each corresponding section of the metal oxide layer. Therefore, the opacity of each pixel can be controlled via the voltage applied to the scanning and data electrodes.

Cross-talk is a problem experienced with some liquid crystal displays in which the voltage applied to pixels on one part of the display influences the transmittance of the liquid crystal on pixels on other parts of the display. This problem is a result of several factors, including parasitic capacitance between the source and gate lines, and voltage drops due to the resistance of the metal oxide layer. As a result, cross-talk is particularly apparent when the display is rendering an image comprising a large bright (white) area on a dark (black or grey) background, or vice versa. In these cases, the bright area appears to bleed into the dark area, or vice versa.

Attempts have been made to reduce the likelihood of cross-talk occurring on a liquid crystal display. For instance, Howard (U.S. Pat. No. 4,845,482) describes applying gating signals to the scanning electrodes for a shorter than normal interval, applying the data signal to the data electrodes during this shorter interval, and applying a compensation signal to the data electrodes during the remainder of the normal interval.

Choi (U.S. Pat. No. 5,774,103) describes driving the data electrodes from +Vd to −Vd through an intermediate voltage level.

Bitzakidis (U.S. Pat. No. 5,798,740) and Kawamori (U.S. Pat. No. 5,691,739) describe applying a compensation voltage to the data signal applied to each column electrode. Bitzakidis bases the compensation voltage on the capacitance of the transistors and the values for all the pixels in the same column. Kawamori bases the compensation voltage on the number of polarity inversions during each display period.

Bassetti (U.S. Pat. No. 5,670,973) describes applying boost voltages to the row and column electrodes in proportion to the number of ON pixels in a row or column, the number of adjacent ON-OFF and OFF-ON pixel pairs in each column, and the position of each such pixel in each row.

All these implementations require modifications to the display drive circuitry or the glass patterning mask tooling.

Murata (US 2004/0239587) describes, for each scan line, determining the average pixel value for the scan line, and then, for each pixel on the scan line, calculating the difference between each pixel value and the calculated average. The difference figures are input into a correction level determining unit that generates correction values based on the difference figures and a non-linear correction function. The correction values are then input into a correction unit that adjusts the value of each pixel based on the corresponding correction value.

FIG. 6 of the patent application depicts a white box surrounded by gray space, and the adjusted pixel values for each pixel on the scan line. As shown, for the line A-A' passing through the white box, the pixel values for the gray space to the left and right of the white box are increased by the correction value ($\alpha$), while the pixel values for the white box remain unchanged. However, for the line B-B' extending through the gray space below the white box, the pixel values for the entire line remain unchanged thereby creating the possibility of a visual discontinuity between the gray space above/below the box and the gray space to the left/right of the box.

SUMMARY OF THE INVENTION

According to a first aspect of the invention described herein, there is provided a method for reducing cross-talk on a liquid crystal display, that begins by receiving pixel data defining an image comprising a plurality of pixels; the received pixel data includes an intensity value associated with each pixel. The image is compressed by reducing the range of the intensity values of all the pixels in the image; the compressing step comprising arithmetically adjusting the intensity values of the pixels. Lines in the compressed image that are disposed to create cross-talk are identified. The image is then decompressed by applying a scale factor to the adjusted intensity value associated only with the pixels in the identified lines. The scale factor is selected such that a display image rendered on a liquid crystal display from the pixel data of the decompressed image has less cross-talk than a display image rendered on a liquid crystal display from the received pixel data.

According to a second aspect of the invention, there is provided a method for reducing cross-talk on a liquid crystal display, that begins by receiving a primary pixel data set defining a primary image; the primary image comprises a plurality of pixels; the primary pixel data set includes an intensity value associated with each pixel. The primary pixel data set is mapped to a secondary pixel data set; the secondary pixel data set defines a secondary image; the intensity values of the pixels in the secondary pixel data set occupy a smaller intensity range than in the primary pixel data set. Lines in the secondary image that are disposed to create cross-talk are identified. A scale factor is then applied to the secondary image data set, in particular to the intensity value associated with each pixel in the identified lines. The scale factor is selected such that a display image rendered on a liquid crystal display from the secondary image data set has less cross-talk than a display image rendered on a liquid crystal display from the primary image.

According to a third aspect of the invention, there is provided a handheld computing device comprising a liquid crystal display, aid a display processor coupled to the liquid crystal display. The display processor includes pixel mapping means, line identifying means, scaling means and imaging means. The pixel mapping means maps pixel data defining a primary image to a secondary image. The primary and secondary images comprise a plurality of pixels; each pixel has an associated intensity value; the intensity values of the pixels in the secondary image occupy a smaller intensity range than in the primary image. The line identifying means identifies lines in the secondary image disposed to create cross-talk. The scaling means applies a scale factor to the intensity value of the pixels in the identified lines. The imaging means renders the secondary image on a liquid crystal display; the scale factor is selected to effect a reduction in cross-talk in the rendered image relative to the primary image.

According to a fourth first aspect of the invention, there is also provided a computer readable medium carrying processing instructions for a computer which, when executed, cause the computer to implement a method for reducing cross-talk on a liquid crystal display. The method begins by converting primary pixel data defining a primary image into secondary pixel data defining a secondary image; the primary and secondary images comprise a plurality of pixels; each pixel has an associated intensity value in the respective pixel data; the intensity values of the pixels in the secondary pixel data have a smaller intensity range than the pixels in the primary pixel data. Lines in the secondary image that are disposed to create cross-talk are identified. A scale factor is then applied to the intensity values in the secondary pixel data associated with the pixels in the identified lines. The scale factor is selected such that the secondary image, when rendered on a liquid crystal display from the secondary pixel data, has less cross-talk than the primary image when so rendered from the primary pixel data.

BRIEF DESCRIPTION OF THE DRAWINGS

The invention will now be described, by way of example only, with reference to the accompanying drawings, in which.

DETAILED DESCRIPTION OF THE PREFERRED EMBODIMENT

Figure 1:
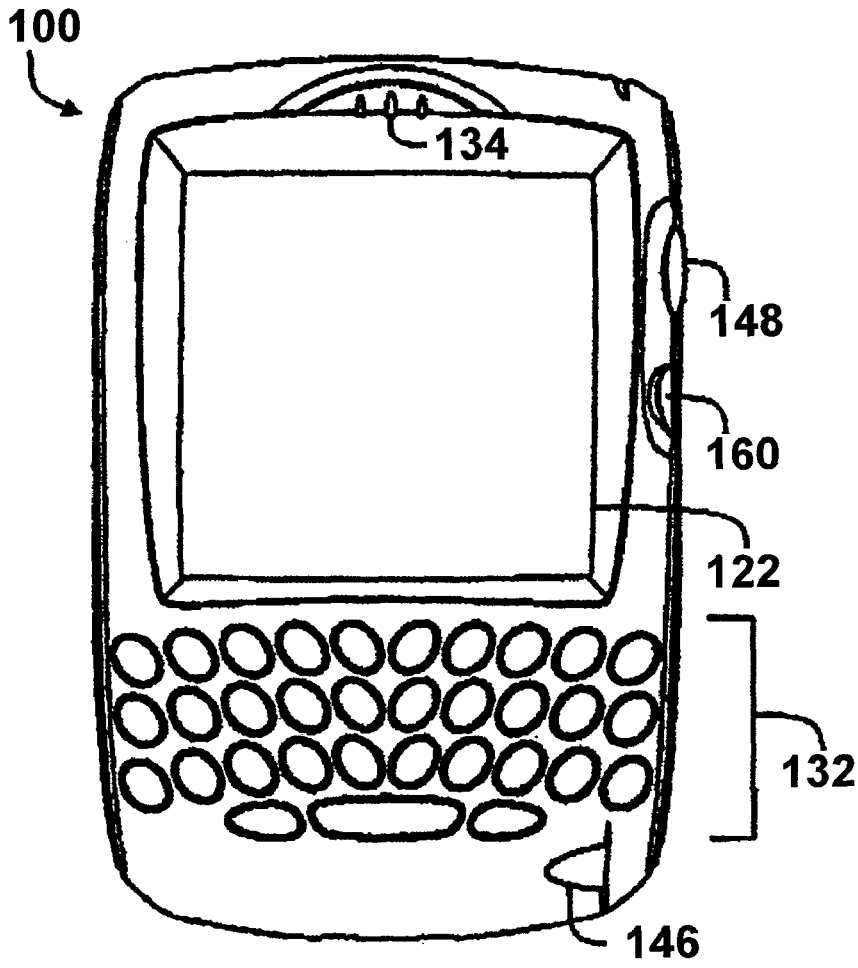
FIG. 1 is a front plan view of a handheld computing device having a display processor and a liquid crystal display, according the invention described herein.

Referring now to FIG. 1, there is shown a handheld computing device, denoted generally as 100, provided according to one aspect of the invention. The handheld computing device 100 includes a display 122, a function key 146, and data processing means 102 (not shown) disposed within a common housing. The display 122 comprises a backlit display having a variable-intensity backlight. In one implementation, the backlit display 122 comprises a transmissive LCD display, and the function key 146 operates as a power on/off switch. Alternately, in another implementation, the backlit display 122 comprises a reflective or trans-reflective LCD display, and the function key 146 operates as a backlight switch.

Figure 2:
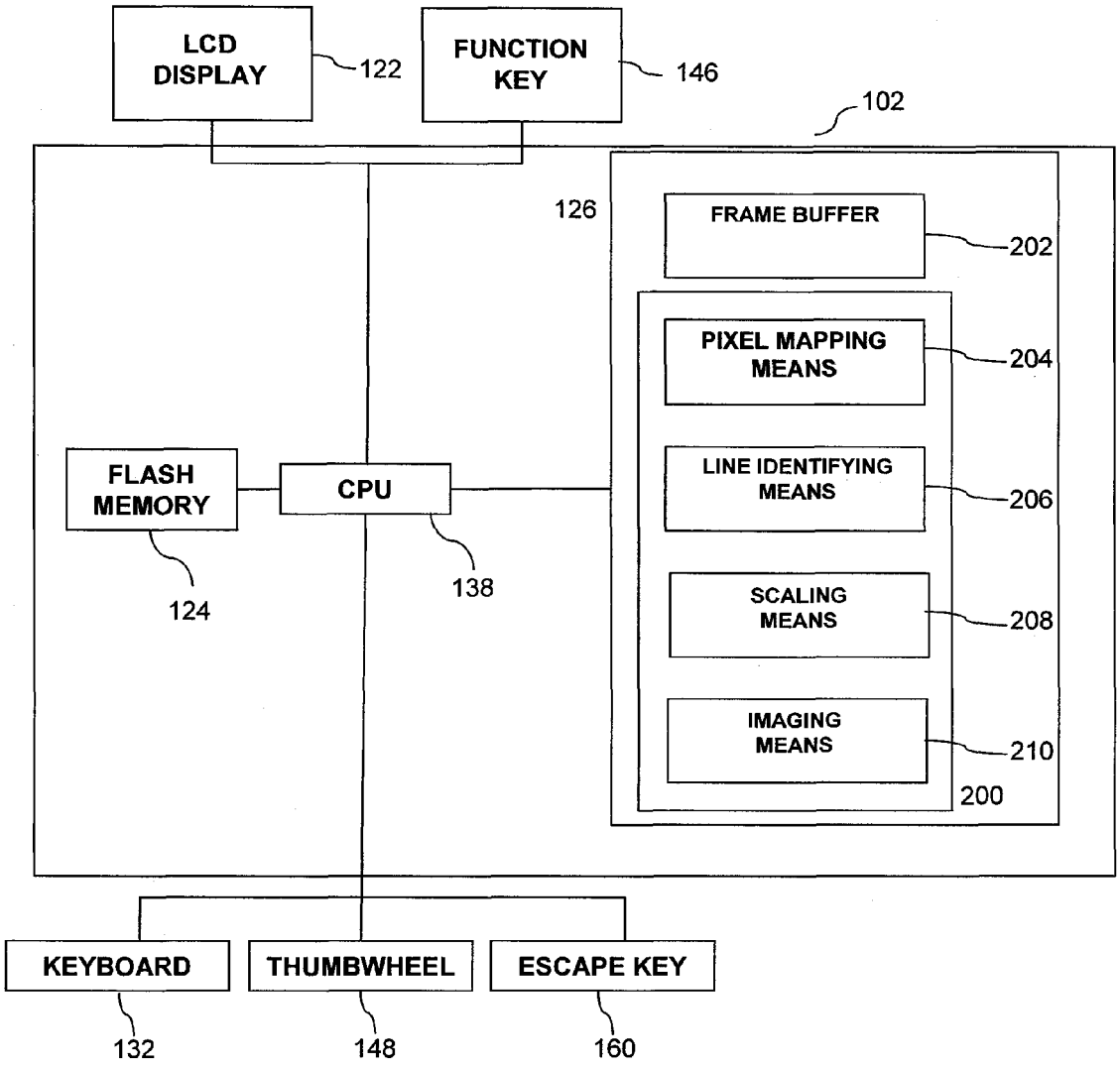
FIG. 2 is a schematic diagram depicting the communication pathways existing between the data processing means, the display processor, the LCD display, the function key and the data input means of the handheld computing device depicted in FIG. 1.

As shown in FIG. 2, the data processing means 102 of the handheld computing device 100 is in communication with the display 122 and the function key 146. In addition to the display 122 and the function key 146, the handheld computing device 100 includes user data input means for inputting data to the data processing means 102. As shown, preferably the user data input means includes a keyboard 132, a thumbwheel 148 and an escape key 160.

The data processing means 102 comprises a microprocessor 138, and a memory 124, 126 (disposed within the housing). The memory 124, 126 computer processing instructions which, when accessed from the memory 124, 126 and executed by the microprocessor 138, implement an operating system, which includes a display processor 200. In addition, the memory 126 includes a frame buffer 202 which the display processor uses to render images on the display 122.

As shown, the computer processing instructions provide the display processor 200 with the functionality of a pixel mapping means 204, a line identifying means 206, a scaling means 208 and an imaging means 210. The function of the pixel mapping means 204, the line identifying means 206, the scaling means 208 and the imaging means 210 will be discussed in greater detail below. However, it is sufficient at this point to note that the pixel mapping means 204, the line identifying means 206, the scaling means 208 and the imaging means 210 configure the display processor 200 with a method that reduces cross-talk on the display 122. It should also be understood that although the display processor 200 is preferably implemented as a set of computer processing instructions, the display processor 200 may be implemented in electronics hardware instead.

Typically, the handheld computing device 100 is a two-way wireless communication device having at least voice and data communication capabilities. Further, preferably the handheld computing device 100 has the capability to communicate with other computer systems on the Internet. Depending on the exact functionality provided, the wireless handheld computing device 100 may be referred to as a data messaging device, a two-way pager, a wireless e-mail device, a cellular telephone with data messaging capabilities, a wireless Internet appliance, or a data communication device, as examples.

Figure 3:
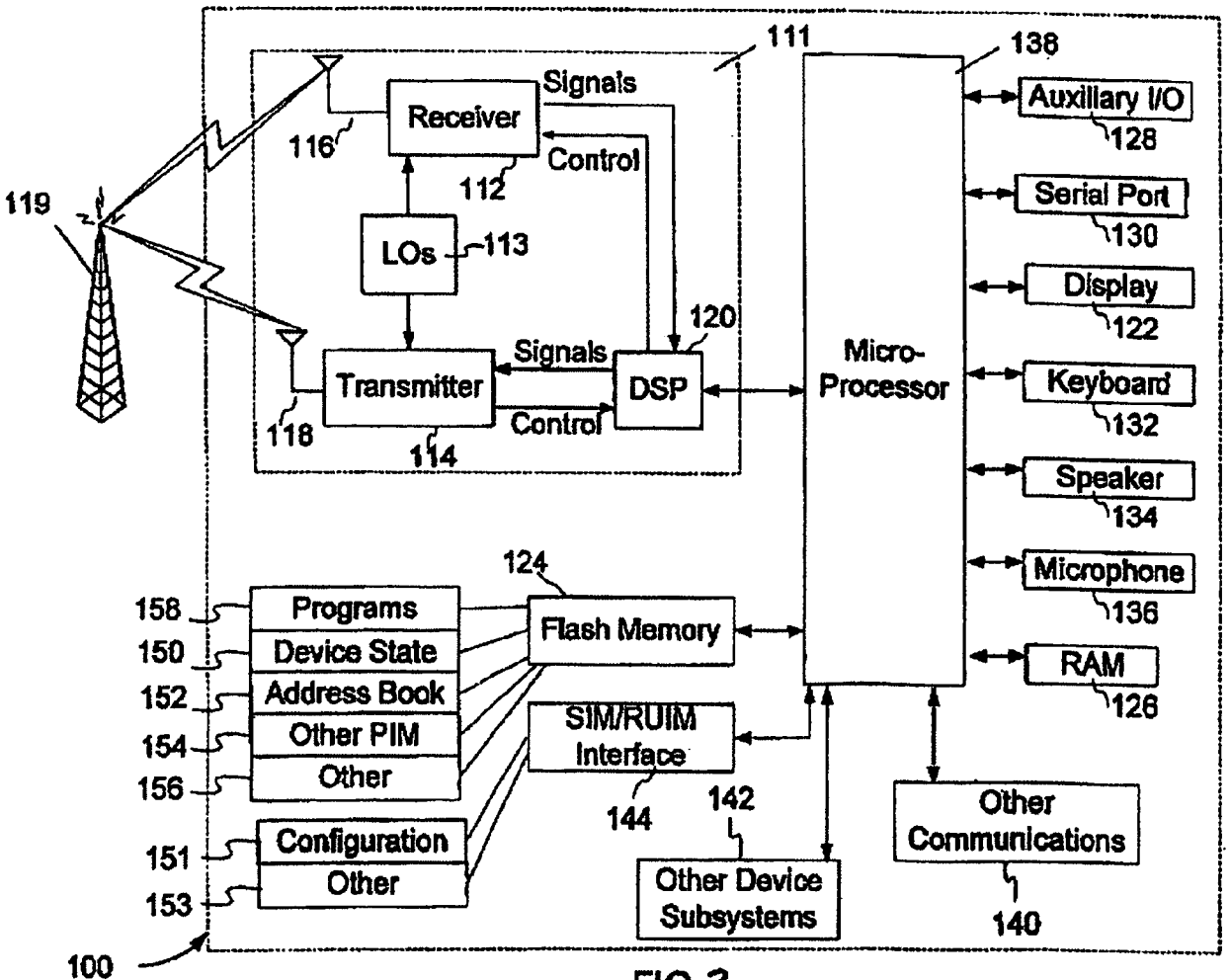
FIG. 3 is a schematic diagram depicting certain functional details of the handheld computing device.

FIG. 3 depicts functional details of the handheld computing device 100. The handheld computing device 100 sends and receives communication signals over the network 119, and comprises a motherboard that includes a communication subsystem 111, a microprocessor 138, and a SIM/RUIM interface 144. The communication subsystem 111 performs communication functions, such as data and voice communications, and includes a receiver 112, a transmitter 114, and associated components such as one or more embedded or internal, antenna elements 116 and 118, local oscillators (LOs) 113, and a processing module such as a digital signal processor (DSP) 120.

Signals received by antenna 116 through communication network 119 are input to the receiver 112, which performs common receiver functions such as frequency down conversion, and analog to digital (A/D) conversion, in preparation for more complex communication functions performed by the DSP 120. In a similar manner, signals to be transmitted are processed by DSP 120 and input to transmitter 114 for digital to analog conversion, frequency up conversion, and transmission over the communication network 119 via antenna 118.

The SIM/RUIM interface 144 is similar to a card-slot into which a SIM/RUIM card can be inserted and ejected like a diskette or PCMCIA card. The SIM/RUIM card holds many key configuration 151, and other information 153 such as identification, and subscriber related information.

The microprocessor 138 controls the overall operation of the device, interacting with device subsystems such as the display 122, flash memory 124, random access memory (RAM) 126, auxiliary input/output (I/O) subsystems 128, serial port 130, keyboard 132, speaker 134, microphone 136, short-range communications subsystem 140, and device subsystems 142. As shown, the flash memory 124 includes both computer program storage 158 and program data storage 150, 152, 154 and 156. The RAM 126 includes a frame buffer 202 which the display processor 200 uses to render images on the display 122.

Computer processing instructions are preferably also stored in the flash memory 124 or other similar non-volatile storage. Other computer processing instructions may also be loaded into a volatile memory such as RAM 126. The computer processing instructions, when accessed from the flash memory 124 and the RAM 126 and executed by the microprocessor 138, define operating system software, computer programs, and operating system specific applications such as the display processor 200. Such computer programs may be installed onto the handheld computing device 100 upon manufacture, or may be loaded through the network 119, the auxiliary I/O subsystem 128, the serial port 130, the short-range communications subsystem 140, or device subsystem 142.

In a data communication mode, a received text message or web page download will be processed by the communication subsystem 111 and output to the display 122, or alternatively to an auxiliary I/O device 128. A user of the handheld computing device 100 may compose data items such as email messages for example, using the keyboard 132. Such composed items may then be transmitted over a communication network through the communication subsystem 111.

For voice communications, overall operation of the handheld computing device 100 is similar, except that received signals would preferably be output to a speaker 134 and signals for transmission would be generated by a microphone 136. Further, the display 122 may provide an indication of the identity of a calling party, the duration of a voice call, or other voice call related information for example.

Figure 4:
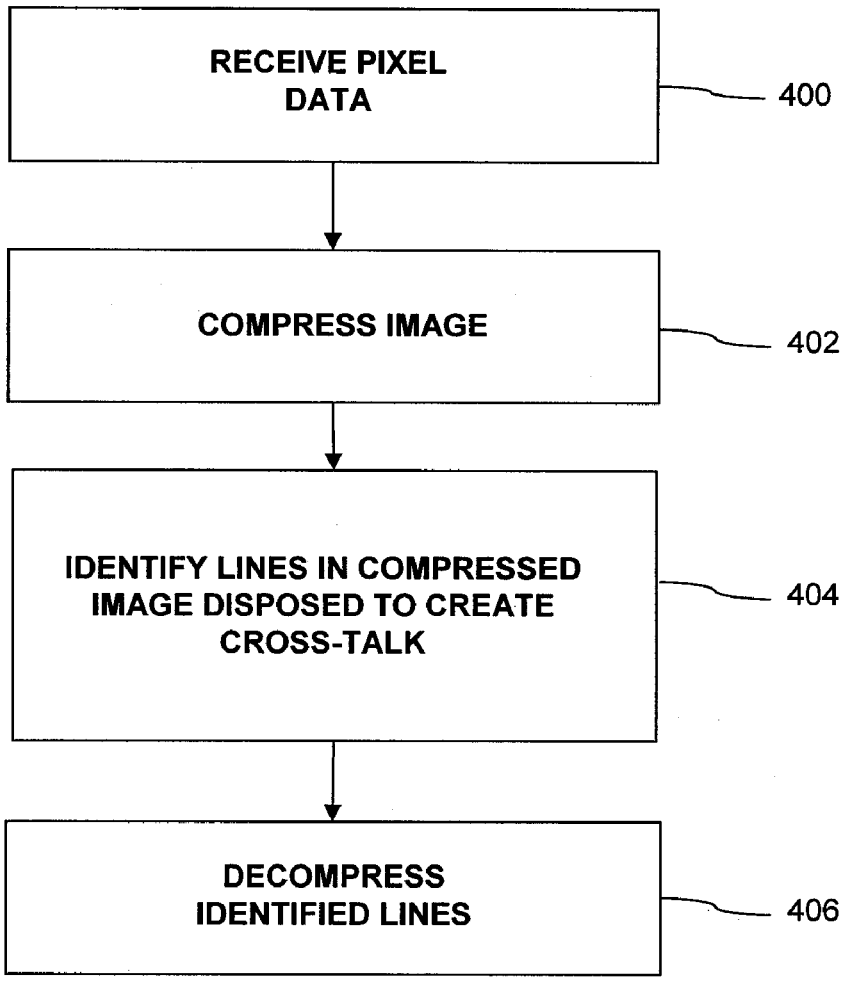
FIG. 4 is a flow chart depicting the method of reducing cross-talk implemented by the display processor.

FIG. 4 is a flow chart that depicts, by way of overview, the sequence of steps performed by the display processor 200 according to the invention. Initially, at step 400, the display processor 200 receives pixel data defining an image comprising a plurality of pixels. The received pixel data includes an intensity value associated with each pixel.

At step 402, the display processor 200 compresses the image by reducing the range of the intensity values of all the pixels in the image. This step involves arithmetically adjusting the intensity values of the pixels so that the range of the intensity values of the pixels fall within a desired range.

At step 404, the display processor 200 identifies lines in the compressed image that are disposed to create cross-talk. Then, at step 406, the display processor 200 decompresses the compressed image by applying a scale factor to the adjusted intensity value associated only with the pixels in the identified lines. The scale factor is selected such that a display image that is rendered on the display from the pixel data of the decompressed image will have less cross-talk than a display image rendered on the liquid crystal display from the pixel data received at step 400.

Figure 5:
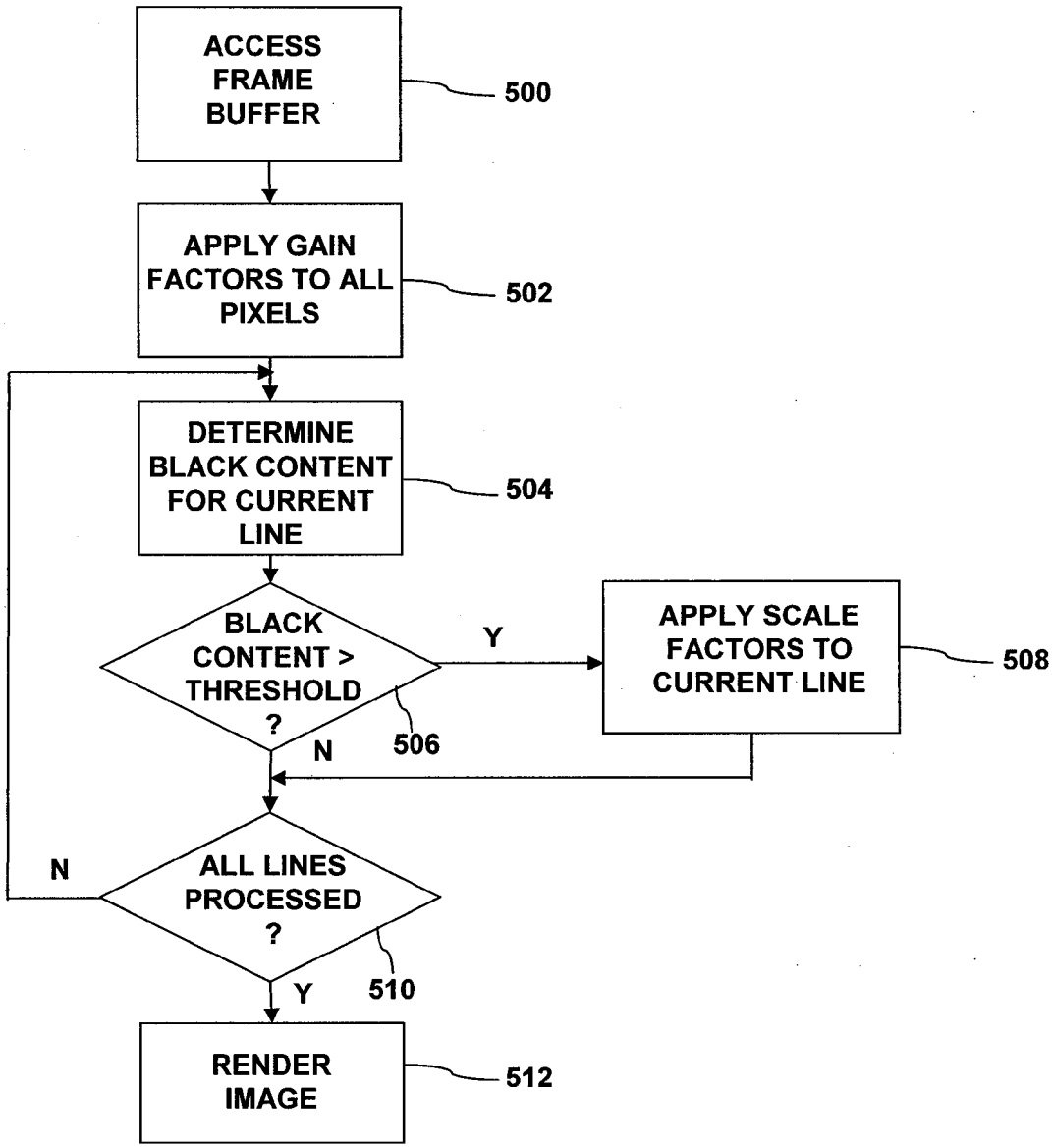
FIG. 5 is a representation of the results of the compressing and decompressing operations performed by the method on a sample image.

FIG. 5 is a flow chart that depicts, in detail, the sequence of steps performed by the display processor 200. Initially, at step 500, the display processor 200 accesses the frame buffer 202 which contains pixel data defining an image to be rendered on the display 122. The image comprises a plurality of pixels, and the pixel data includes an intensity value for each pixel.

The intensity values of the pixels in the image have a primary maximum possible range that extends between a primary minimum intensity value and a primary maximum intensity value. The primary maximum possible range will depend on the number of data bits used to define the intensity of each pixel.

After accessing the pixel data, the display processor 200 arithmetically adjusts the intensity values of the pixels so that the intensity values of all the pixels fall within a secondary maximum possible range that is smaller than the primary maximum possible range. To do so, at step 502, the pixel mapping means 204 applies a gain factor to the intensity value of each pixel in the image.

After application of the gain factors, the range of the intensity values of all the pixels extends between a secondary minimum intensity value and a secondary maximum intensity value. Preferably, the gain factors are selected so that the secondary minimum intensity value is greater than the primary minimum intensity value, but the secondary maximum intensity value is less than the primary maximum intensity value. Further, preferably the gain factors vary linearly over the primary maximum possible range of the pixel intensity values.

Figure 6:
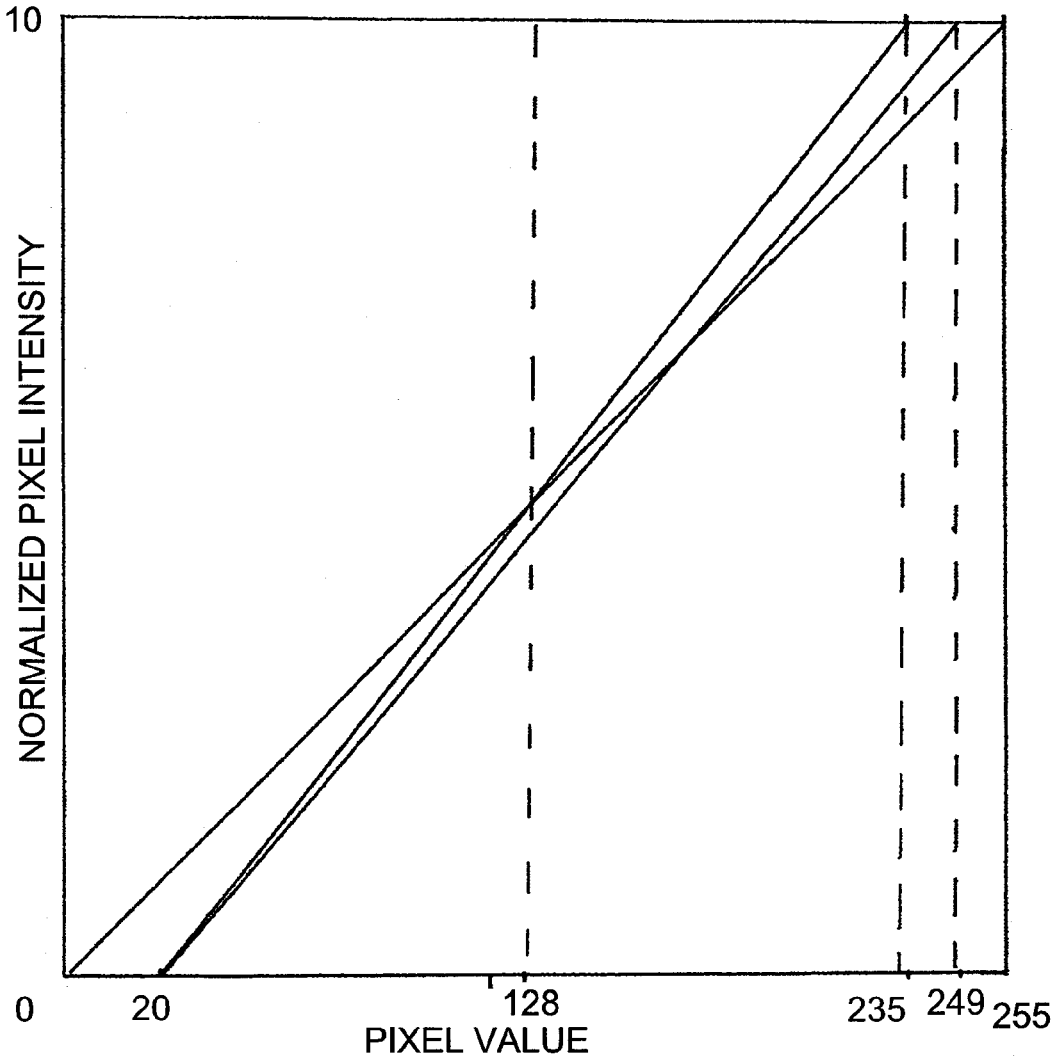
FIG. 6 is a graph depicting the gain and scale factors used by the method on the intensity values of the pixels in the image.

The effect of step 502 on the pixel data can be understood from the example shown in FIG. 6. Reference numeral 600 indicates the maximum possible range of the pixel intensity values at step 500. As shown, eight (8) data bits are used to define the intensity of each pixel, so that the primary minimum intensity value is 0, the primary maximum intensity value is 255, and the primary maximum possible range of the pixel intensity values is 0:255.

Reference numeral 602 indicates the maximum possible range of the pixel intensity values after application of the gain factors. As shown, the secondary minimum intensity value is 20, the secondary maximum intensity value is 235, and the secondary maximum possible range of the pixel intensity values is 20:235. As a result, the gain factor is +20 for a primary pixel intensity value of 0; −20 for a primary pixel intensity value of 255; and 0 for a primary pixel intensity value of 128. Further, the gain factors vary linearly between +20 and −20 over the primary maximum possible range (0:255) of the pixel intensity values.

Figure 7C:
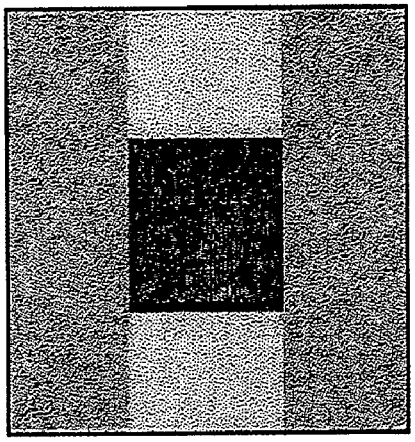
FIGS. 7*a*, 7*b* and 7*c* represent the contents of the frame buffer of the data processing means at various steps in the method.
Figure 7B:
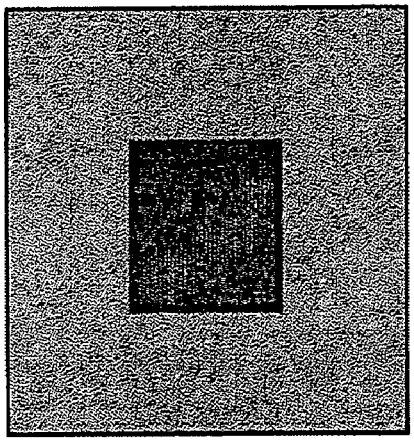
Figure 7A:
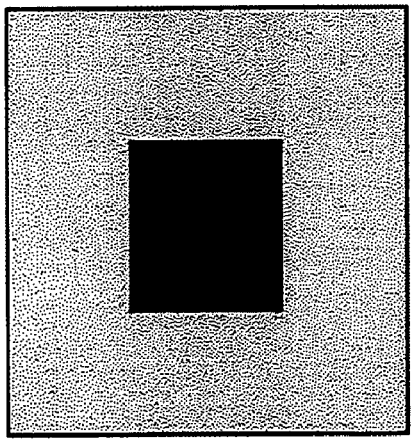
Figure 8C:
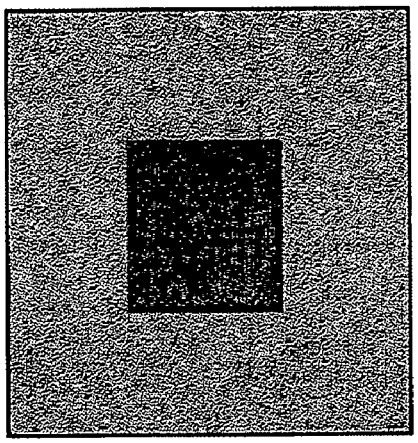
FIGS. 8*a*, 8*b* and 8*c* represent an image rendered from the contents of the frame buffer, as depicted in FIGS. 7*a*, 7*b* and 7*c*, respectively.
Figure 8B:
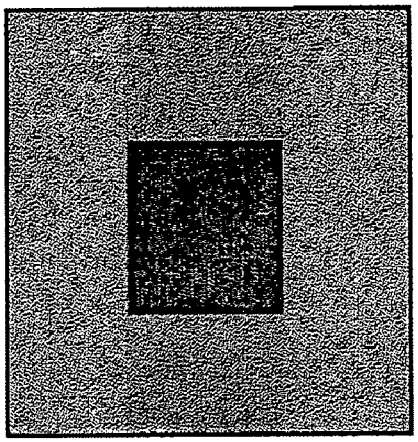
Figure 8A:
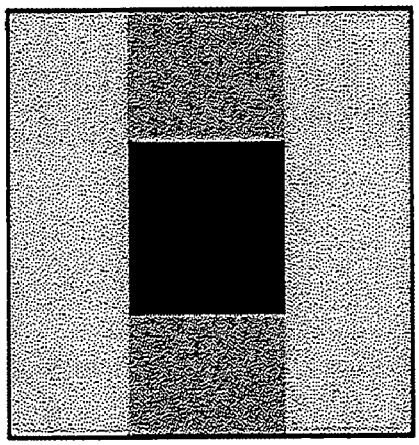

The effect of step 502 on the pixel data is depicted in FIGS. 7*a*, 7*b*, 8*a* and 8*b*. FIG. 7*a* represents the contents of the frame buffer 202 at step 500, and FIG. 8*a* represents the image (the "primary image") that would be rendered on the display 122 from the contents of the frame buffer 202 as at step 500. In the example of FIG. 7*a*, the pixel data in the frame buffer 202 is configured to render on the display 122 a black square on a light grey background. As shown in FIG. 8*a*, the pixel data image would produce cross-talk on the display 122. Although FIG. 8*a* indicates that the primary image would be depicted with horizontal cross-talk, depending on the characteristics of the display 122, the primary image could also be depicted with vertical cross-talk.

FIG. 7*b* represents the contents of the frame buffer 202 at step 502, and FIG. 8*b* represents the image (the "secondary image") that would be rendered on the display 122 from the contents of the frame buffer 202 as at step 502. As shown in FIG. 7*b*, after application of the gain factors, the intensity values for all the pixel data in the frame buffer 202 are compressed, such that the range of intensity values of the pixels in the secondary image is smaller than the range of intensity values of the pixels in the primary image. As a result, as shown in FIG. 8*b*, the black square would appear to be lighter (less black) in the secondary image than in the primary image, and the light grey background would appear to be (less white) in the secondary image than in the primary image.

The display processor 200 then identifies lines in the compressed image that are disposed to create cross-talk. To do so, at step 504 the line identifying means 206 determines the black content for each line in the secondary image. Typically, the line identifying means 206 determines the black content by calculating the average intensity level for all the pixels in each line.

Typically, the line identifying means 206 will determine the black content for each horizontal line. However, the identifying means 206 can also be configured to determine the black content for each vertical line if the display 122 is predisposed to vertical cross-talk.

If the black content for a line is high, the pixel data for that line is considered likely to create cross-talk on the display 122. Accordingly, at step 506, the line identifying means 206 compares the determined black content for the current line of the secondary image against a predetermined threshold. If the determined black content for the current line is greater than the predetermined threshold, at step 508 the scaling means 208 applies a scale factor to the intensity values for the pixels in the current line. However, if the determined black content for the current line is not greater than the predetermined threshold, the scaling means 208 does not apply any scale factor to the current line.

At step 510, the display processor 200 determines whether all lines of the image have been analyzed. If additional lines remain to be analyzed, processing returns to step 500. However, if all lines of the image have been analyzed, at step 512 the imaging means 210 renders the image on the display 122 from the resulting pixel intensity data.

The scale factors applied in step 508 are selected such that the rendered image will have less cross-talk than would a display image rendered on the display 122 from the pixel data of the primary image. To achieve this result, the scale factors are selected such that the intensity values of all the pixels in the lines identified at step 506 (lines that are disposed to create cross-talk) occupy a larger intensity range than the range resulting from the application of the gain factors at step 502. However, the intensity values of all the pixels in the lines identified at step 506 also occupy a narrower intensity range than in the primary image.

Preferably, the scale factors vary linearly over the intensity range of the pixels of the secondary image between a minimum adjustment value and a maximum adjustment value. Typically, the pixels that are associated with the colour black on lines having high black content are least prone to cross-talk, whereas the pixels that are associated with the colour white on lines having high black content are most prone to cross-talk. Accordingly, preferably the minimum and maximum adjustment values are selected such that the intensity values of the pixels that are associated with the colour black on lines having high black content receive a minimal adjustment, whereas the intensity values of the pixels that are associated with the colour white on lines having high black content receive the largest adjustment.

The effect of step 508 on the pixel data can be understood from the example shown in FIG. 6. Reference numeral 602 indicates the maximum possible range of the pixel intensity values after application of the gain factors at step 508. As shown, the secondary minimum intensity value is 20, the secondary maximum intensity value is 235, and the secondary maximum possible range of the pixel intensity values is 20:235.

Reference numeral 604 indicates the maximum possible range of the pixel intensity values after application of the scale factors. As shown, the final minimum intensity value is equal to the secondary minimum intensity value (20). However, the final maximum intensity value is 249, which is greater than the secondary maximum intensity value (235) but less than the primary maximum intensity value (255). Therefore, the final maximum possible range of the pixel intensity values is 20:249. As a result, the scale factor is 0 for a secondary pixel intensity value of 0; and +14 for a secondary pixel intensity value of 235. Further, the scale factors vary linearly between 0 and +14 over the final maximum possible range (20:249) of the pixel intensity values.

The effect of step 508 on the pixel data is depicted in FIGS. 7*c* and 8*c*. FIG. 7*c* represents the contents of the frame buffer 202 after step 508, and FIG. 8*c* represents the image rendered on the display 122 from the contents of the frame buffer 202 as at step 508. As shown in FIG. 7*c*, after application of the scale factors, the intensity values of the pixels in the lines identified in step 506 that correspond to grey background are increased above the intensity values of those pixels in the secondary image, but not back to the original intensity values those pixels had in the primary image. However, the intensity values of the pixels in the lines identified in step 506 that correspond to the black square remain unchanged. Further, the intensity values for the pixels in the lines not identified in step 506 also remain unchanged.

In effect, decompressing step 508 increases the intensity of the pixels most prone to cross-talk. Compressing step 502 reduces the dynamic range of the pixel intensity of all the pixels in the image, to thereby allow the intensity of the pixels most prone to cross-talk to be increased. As a result, as shown in FIG. 8*c*, when the imaging means 210 renders the final image on the display 122 from the resulting pixel intensity data, the grey background on the horizontal lines containing the black square appears to have the same intensity as the grey background on the horizontal lines above and below the black square.

The scope of the monopoly desired for the invention is defined by the claims appended hereto, with the foregoing description being merely illustrative of the preferred embodiment of the invention. Persons of ordinary skill may envisage modifications to the described embodiment which, although not explicitly suggested herein, do not depart from the scope of the invention, as defined by the appended claims.

The invention claimed is:

1. A method for reducing cross-talk on a liquid crystal display, comprising the steps of:

mapping pixel data of a primary image to pixel data of a secondary image, the primary and secondary images each comprising a plurality of pixels defined by the respective pixel data, the pixel data comprising intensity values for each said pixel, a range of the intensity values of the pixels of the secondary image being smaller than a range of the intensity values of the pixels of the primary image;

identifying lines in the secondary image disposed to create cross-talk, the line identifying comprising, for each said line in the secondary image, determining a black content of said line, and comparing the determined black content against a predetermined threshold; and adjusting the intensity values of the pixels in the identified lines such that a display image rendered on a liquid crystal display resulting from the pixel intensity adjusting has less cross-talk than if rendered from the pixel data of the primary image, the pixel intensity adjusting comprising applying a respective scale factor to the intensity value of each said pixel in each said identified line, the scale factor being a minimum adjustment value for the pixels least prone to cross-talk, a maximum adjustment value for the pixels most prone to cross-talk, and otherwise a variable adjustment between the minimum adjustment value and the maximum adjustment value determined based on the intensity value of the respective pixel.

2. The method according to claim 1, wherein the intensity values of the pixels of the secondary image are between a secondary minimum intensity and a secondary maximum intensity, and the scale factors are selected such that, for the pixels in the identified lines, the intensity values proximate the secondary maximum intensity are provided with a larger adjustment than the intensity values proximate the secondary minimum intensity.

3. The method according to claim 2, wherein a range of the intensity values of the pixels of the identified lines of the rendered image is larger than a range of the intensity values of the pixels of the corresponding lines of the secondary image, but smaller than a range of the intensity values of the pixels of the corresponding lines of the primary image.

4. The method according to claim 3, wherein the variable adjustment varies linearly between the minimum adjustment value and the maximum adjustment value.

5. The method according to claim 2, wherein the range of the intensity values of the pixels of the primary image extends between a primary minimum intensity and a primary maximum intensity, and the data mapping comprises applying a gain factor to the intensity values of the pixels of the primary image, the gain factor varying linearly between the primary minimum intensity and the primary maximum intensity.

6. The method according to claim 5, wherein the secondary minimum intensity is greater than the primary minimum intensity, and the secondary maximum intensity is less than the primary maximum intensity.

7. The method according to claim 6, wherein the black content determining step comprises, for each said line, calculating an average intensity level for all the pixels in said line.

8. A handheld computing device comprising:

a liquid crystal display; and a display processor coupled to the liquid crystal display, the display processor including:

pixel mapping means for mapping pixel data of a primary image to pixel data of a secondary image, the primary and secondary images each comprising a plurality of pixels defined by the respective pixel data, the pixel data comprising intensity values for each said pixel, a range of the intensity values of the pixels of the secondary image being smaller than a range of the intensity values of the pixels of the primary image;

identifying means for identifying lines in the secondary image disposed to create cross-talk, the line identifying means being configured to identify the lines by determining a black content of each said line in the secondary image, and to compare the determined black content against a predetermined threshold;

scaling means for applying a respective scale factor to the intensity value of each said pixel in each said identified line, the scale factor being a minimum adjustment value for the pixels least prone to cross-talk, a maximum adjustment value for the pixels most prone to cross-talk, and otherwise a variable adjustment between the minimum adjustment value and the maximum adjustment value determined based on the intensity value of the respective pixel; and imaging means for rendering on the liquid crystal display a display image from the pixel data resulting from the scaling means, the scale factor being selected such that the rendered image has less cross-talk than if rendered from the pixel data of the primary image.

9. The handheld computing device according to claim 8, wherein the intensity values of the pixels of the secondary image are between a secondary minimum intensity and a secondary maximum intensity, and the scaling means is configured to apply the minimum adjustment to the intensity values of the pixels in the identified liens least prone to cross-talk, and to apply the maximum adjustment value to the intensity values of the pixels in the identified lines more prone to cross-talk.

10. The handheld computing device according to claim 9, wherein the scaling means is configured to manipulate the intensity values of the pixels such that a range of the intensity values of the pixels of the identified lines of the rendered image is larger than a range of the intensity values of the pixels of the corresponding lines of the secondary image, but smaller than a range of the intensity values of the pixels of the corresponding lines of the primary image.

11. The handheld computing device according to claim 10, wherein the variable adjustment varies linearly between the minimum adjustment value and the maximum adjustment value.

12. The handheld computing device according to claim 9, wherein the range of the intensity values of the pixels in the primary image extends between a primary minimum intensity and a primary maximum intensity, and the pixel mapping means is configured to map the pixel data by applying a gain factor to the intensity values of the pixels in the primary image, the gain factor varying linearly between the primary minimum intensity and the primary maximum intensity.

13. The handheld computing device according to claim 12, wherein the secondary minimum intensity is greater than the primary minimum intensity, and the secondary maximum intensity is less than the primary maximum intensity.

14. The handheld computing device according to claim 13, wherein the line identifier is configured to determine the black content by, for each said line, calculating an average intensity level for all the pixels in said line.

15. A computer-readable medium carrying processing instructions for a computing device which, when executed, cause the computing device to implement a method for reducing cross-talk on a liquid crystal display, the method comprising the steps of:

mapping pixel data of a primary image to pixel data of a secondary image, the primary and secondary images each comprising a plurality of pixels defined by the respective pixel data, the pixel data comprising intensity values for each said pixel, a range of the intensity values of the pixels of the secondary image being smaller than a range of the intensity values of the pixels of the primary image;

identifying lines in the secondary image disposed to create cross-talk, the line identifying comprising, for each said line in the secondary image, determining a black content of said line, and comparing the determined black content against a predetermined threshold; and adjusting the intensity values of the pixels in the identified lines such that a display image rendered on a liquid crystal display resulting from the pixel intensity adjusting has less cross-talk than if rendered from the pixel data of the primary image, the pixel intensity adjusting comprising applying a respective scale factor to the intensity value of each said pixel in each said identified line, the scale factor being a minimum adjustment value for the pixels least prone to cross-talk, a maximum adjustment value for the pixels most prone to cross-talk, and otherwise a variable adjustment between the minimum adjustment value and the maximum adjustment value determined based on the intensity value of the respective pixel.

16. The computer-readable medium according to claim 15, wherein the intensity values of the pixels of the secondary image are between a secondary minimum intensity and a secondary maximum intensity, and the scale factors are selected such that, for the pixels in the identified lines, the intensity values proximate the secondary maximum intensity are provided with a larger adjustment than the intensity values proximate the secondary minimum intensity.

* * * * *